United States Patent [19]

McCaffrey et al.

[11] Patent Number: 4,597,339

[45] Date of Patent: Jul. 1, 1986

[54] PALLET

[76] Inventors: Hugh McCaffrey, 534 Fourth St., Encinidas, Calif. 92024; Paul Scheibe, P.O. Box 1809, Rancho Santa Fe, Calif. 92067; Bruce A. Spear, 597 S. Sierra #59, Solana Beach, Calif. 92075

[21] Appl. No.: 694,155

[22] Filed: Jan. 23, 1985

Related U.S. Application Data

[63] Continuation of Ser. No. 368,103, Apr. 14, 1982, abandoned.

[51] Int. Cl.[4] ..... B65D 19/00; A63G 21/00

[52] U.S. Cl. ..... 108/51.1; 104/135

[58] Field of Search ..... 108/51.1, 55.1, 56.1, 108/57.1, 51.3; 206/386, 599; 198/472; 104/135, 168

[56] References Cited

U.S. PATENT DOCUMENTS

| | | | |
|---|---|---|---|
| 2,503,240 | 4/1950 | Cahners | 108/51.3 |
| 2,668,861 | 2/1954 | Kappen | 108/51.1 |
| 2,949,863 | 8/1960 | Cozzoli | 108/51.1 |
| 3,010,409 | 11/1961 | Good et al. | 108/51.1 |
| 3,026,817 | 3/1962 | Sebastian et al. . | |
| 3,330,228 | 7/1967 | Donnelly . | |
| 3,707,929 | 1/1973 | Lauffer . | |
| 3,760,741 | 9/1973 | Belcher . | |
| 3,768,416 | 10/1973 | Juechter | 104/135 |
| 3,881,429 | 5/1975 | Seymore | 108/51.3 |
| 3,954,067 | 5/1976 | Miles | 108/51.1 |

FOREIGN PATENT DOCUMENTS

| | | | |
|---|---|---|---|
| 52101 | 11/1966 | Fed. Rep. of Germany | 108/51.1 |

*Primary Examiner*—William E. Lyddane
*Assistant Examiner*—Mark W. Binder
*Attorney, Agent, or Firm*—Kenyon & Kenyon

[57] ABSTRACT

An all-steel winged pallet has a deck formed of hollow steel tubes welded at each end to a support member. The support members extend perpendicular to the deck tubes and parallel to each other and have generally U-shaped cross-sections that are mirror images to each other. The inner side of the U is welded to the tubes at a location spaced inwardly from the respective end of the tube, and the outer side is bent outwardly to form a shelf and is then bent upwardly to be welded to the end region of the tubes. The shelf includes a roller contact area under the outermost part of the deck tubes to ride on rollers of a gravity-flow rack system and a guide that extends longitudinally along the shelf to provide a surface against which the rollers can bear.

12 Claims, 3 Drawing Figures

PALLET

This a continuation of U.S. application Ser. No. 368,103 filed Apr. 14, 1982 now abandoned.

BACKGROUND OF THE INVENTION

1. Field of the Invention

This invention relates to pallets of the type used in gravity-flow rack systems, and in particular, it relates to a type of pallet that has a deck formed of hollow steel tubes and supporting members formed of sheet steel. The support members have roller contact areas and are welded to the deck tubes to produce a pallet structure of greater strength and rigidity than gravity-flow pallets known heretofore.

2. Prior Art

Gravity-flow rack systems are used for storage and transportation of goods within a warehouse or other storage area. The racks include parallel rail systems with rollers mounted on them and extending above the upper surface of the rails, and the pallets to be used in such systems having flanges, or wings, extending laterally outward so that they can rest on the rollers to move easily along the rails with only low rolling friction to be overcome. By constructing the racks so that they are inclined in the right direction, the force of gravity is sufficient to move the pallets, loaded or not, and it is unnecessary to supply additional motive power.

One of the advantages of the gravity-flow system is that it forces a certain order in the transfer of the stored material from an entrance location to an outlet location. The fact that the pallets move under the force of gravity causes those that were first entered at the upper end of the system to emerge first from the lower end of the system, i.e. the storage on the inclined racks is first-in-first-out. This is especially useful in the case of products that may be subject to deterioration with age, such as food products, but it is also useful in maintaining orderly inventory turnover of products that do not deteriorate.

Pallets made heretofore for use in gravity-flow rack systems have most commonly used wooden deck planks with sheet metal tracks along two opposite edges to rest on the uppermost surface of the rollers supported by the rails. One of the disadvantages of such pallets is that the wood is subject to deterioration in use and needs to be replaced relatively frequently. The sheet metal tracks can be pulled away from the deck planks relatively easily, or even destroyed, so that such pallets are likely to require substantial repair or replacement twice a year.

Pallets with wood comprising the main portion are shown in U.S. Pat. No. 3,026,817. The pallets in that patent have sheet metal edge portions attached along opposite edges to engage and be guided by rollers spaced along the track. While not all pallets that use wood as a main construction component have the type of multi-layer deck shown in U.S. Pat. No. 3,026,817, they are still likely to be relatively heavy, and typically about 75 pounds for a wooden pallet 48" long and 40" wide, which is one of the most popular sizes.

Several forms of plastic or plastic-coated pallets are described in U.S. Pat. Nos. 3,330,228; 3,707,929; and 3,760,741. In the latter two, the edges of the pallets that extend over track rollers are covered by sheet metal attached to the plastic to conform to the shape of the pallet structure and to rest directly on the rollers. Such plastic and plastic-coated pallets are subject to breakage when they are engaged by the tines of a fork lift truck or the like. Furthermore the plastic structure requires a mold, which tends to fix the size of the pallets and to prevent an easy change in production of pallets from one size to another. Plastic pallets, such as are shown in U.S. Pat. No. 3,330,228, that have no sheet metal components to rest on the rollers are likely to be subjected to a good deal of wear and tear in usage. Even those pallets that do have sheet metal rails, such as are shown in U.S. Pat. Nos. 3,707,929 and 3,760,741, run the risk of having the sheet metal rails separated from the plastic part of the pallets in the same way as pallets that have wooden decks.

In gravity-flow rack systems, it is desirable to be able to make the tracks relatively long so that a large number of pallets can be lined up, one behind the other. In addition, it is common to provide a tunnel structure that makes the pallets relatively inaccessible except at the entrance and outlet ends. However, a long track, and particularly a tunnel, makes it necessary that the pallets follow the rails precisely and not go askew. In the case of pallets made of wood with sheet metal edges to rest on the rollers, the guiding effect is lost when the sheet metal becomes sufficiently separated from the wood. In recognition of the fact that such malfunctioning of the pallets can take place, it is common to make gravity-flow rack systems relatively short, which limits the amount of goods that can be stored in one group of racks and makes it necessary to handle the pallets by a fork lift or handjack device relatively frequently.

OBJECTS AND SUMMARY OF THE INVENTION

It is one of the objects of the present invention to provide an improved winged pallet assembled of sheet metal components welded together to form a unitary structure of great strength.

Another important object of the invention is to provide welded metal pallets that are substantially lighter in weight than pallets constructed primarily of wood.

Still another object is to provide pallets with roller tracks made of sheet metal, welded to hollow tubular steel deck members to form pallets capable of withstanding substantial abuse without being destroyed.

Still another object of the invention is to provide an improved pallet having sheet metal hollow tubes for deck members welded to other sheet metal members along opposite ends of the tubes, the sheet metal members' being shaped to serve as steel roller tracks with integral guide portions to hold the pallet in line on an elongated gravity-feed rack system.

In accordance with this invention, the pallet is constructed of a plurality of hollow steel tubes extending parallel to each other and attached to sheet steel roller track members at each end of the tubes. The roller track members extend parallel to each other and substantially perpendicular to the tubes, and each of the roller track numbers has a general U-shaped cross section formed by a first side attached to the tubes inwardly spaced from one end thereof, a second side attached to the tubes approximately at the end, and a bight portion joining the two sides together. The bight portion is the part of the roller track members farthest away from the deck tubes, and at some location between the bight portion and the lower surface of the deck tubes, the second side of the roller track member is bent outwardly away from the first side to form a roller contact area, and is then bent upwardly and then inwardly to form a flange attached to the tubes. In addition, each of the roller tracks includes a guide member that extends longitudinally along the roller track and is offset from the roller contact area so that the rollers can bear against the guide member to hold the pallet in line on a series of aligned rollers along a track. Preferably, a sheet metal bridging member is inserted within the U-shaped roller tracks to keep the first and second sides properly spaced.

DETAILED DESCRIPTION OF THE INVENTION

Figure 1:
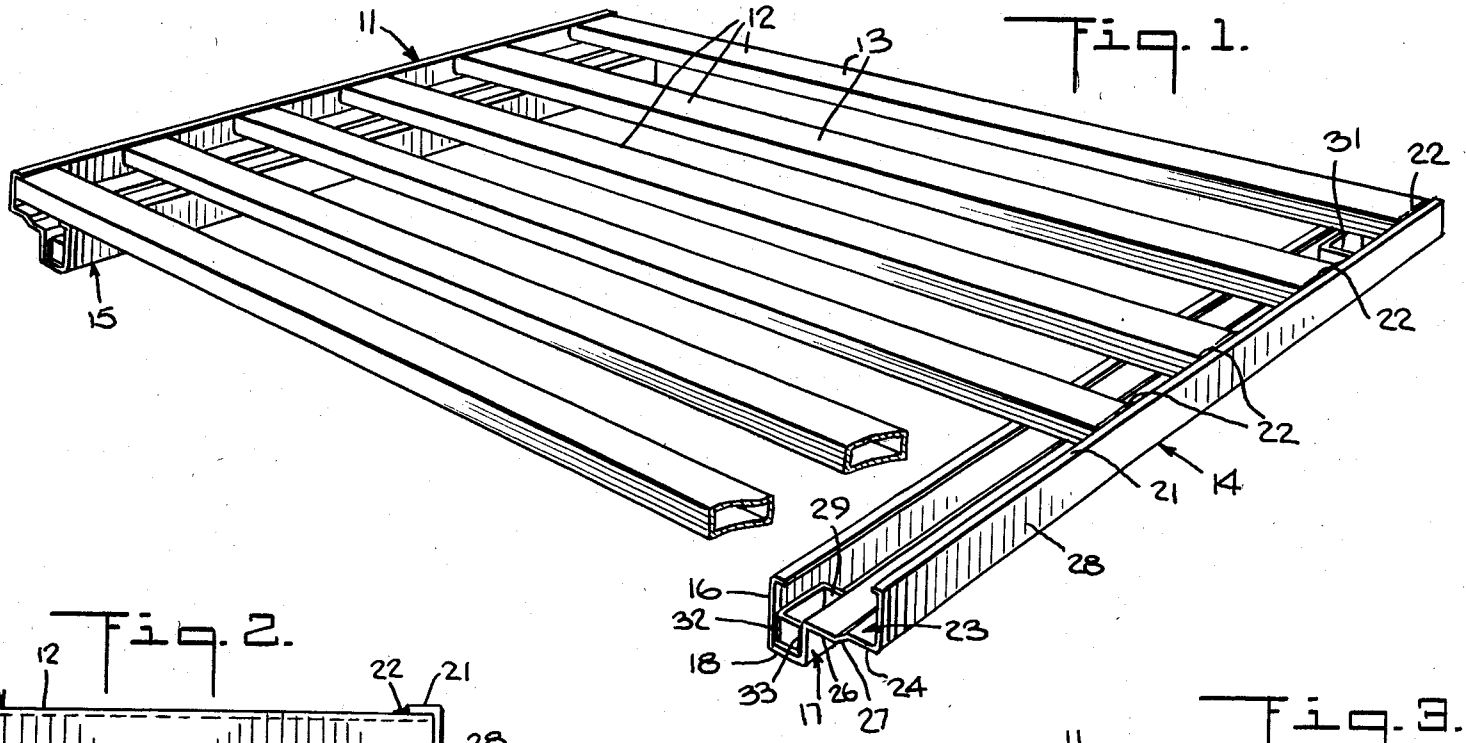
FIG. 1 is a perspective view of one end of a pallet constructed according to the invention with parts broken away to show some of the structural features.

FIG. 1 shows part of winged pallet 11 comprising a plurality of hollow steel deck tubes 12 arranged parallel to each other and all of the same length, which substantially corresponds to the width of the pallet. The hollow steel tubes are rectangular in cross section and, in this embodiment, are of 16 gauge steel and have a thickness of about 1" and a width of about 2". They are shown spaced apart by a distance approximately equal to the width although they may be spaced farther apart if the pallet will not be required to support loads as heavy as the pallet in FIG. 1 is capable of supporting. The upper surfaces 13 of the tubes all lie in substantially the same plane, which may be referred to as a flat deck plane. Wooden pallets used heretofore for the same purpose have frequently been 48" long and 40" wide, although other sizes are sometimes used, and the all-steel pallet 11 is expected to be approximately the same sizes.

Two generally U-shaped support members 14 and 15 are connected to opposite ends of the tubes 12. The U-shaped cross section of the roller track number 14 includes a first side 16, a second side 17, and a bight portion 18 that joins the first and second sides together. The upper edge of the first side 16 is bent substantially at a right angle to form a flange 19 on which all of the tubes 12 rest and to which each of them is welded. The second side 17 has a flange 21 at its edge which is at a higher level than that of the flange 19 and is welded to the tubes 12 by welds 22. Between the bight 18 and the flange 21, the second side 17 is bent outwardly to form a shelf 23, the outer part of which comprises a roller contact area 24 to rest on rollers of the gravity-flow rack system. The part 26 of the shelf 23 adjacent the lower part of the side 17 is displaced from the plane of the roller contact area 24 by an inclined web 27 that forms a guide member extending longitudinally along one side of the roller contact area. Between the shelf 23 and the flange 21, the second side 17 has a portion 28 that is bent upwardly so as to be substantially parallel to the first side 16 to extend over the ends of the tubes 12.

In order to reenforce the U-shaped support member 14, and secondarily to maintain the parallelism between the first and second sides 16 and 17 adjacent the bight portion 18, sheet metal reenforcements 29 and 31 are welded in place. Two of such welds 32 and 33 can be seen in FIG. 1. The sheet metal reenforcements, which can be short lengths of the same tubular steel material used to made the tubes 12, are placed between the sides 16 and 17 with the hollow channel of each of the reenforcements facing directly upwardly, parallel to the side walls 16 and 17 and perpendicular to the bight portion 18.

The support member 15 is a mirror image of the support member 14 and, therefore, need not be described in detail.

Figure 2:
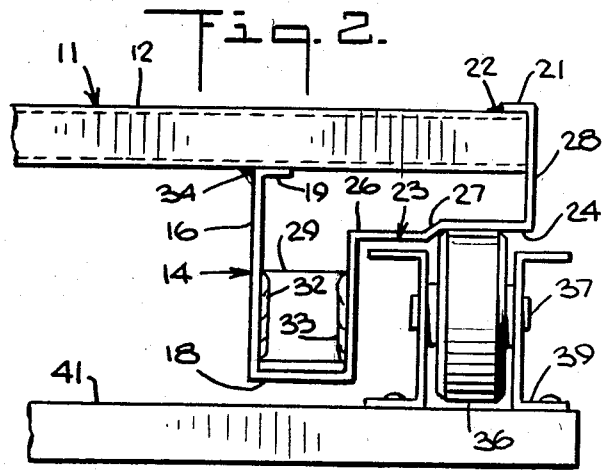
FIG. 2 is an end view of one of the roller tracks in the pallet of FIG. 1 and an adjacent part of a tubular steel deck member.

FIG. 2 shows an end view of the support member 14 and the adjacent part of one of the tubes 12; the other deck tubes are directly behind the one shown. The first side 16 forms a flat wall substantially perpendicular to the tubes 12 and having a height great enough to allow the tines of a fork lift or a hand jack device to be inserted under the tubes 12 when the bight portion 18 is resting on the floor. Typically, the distance between the bight portion 18 and the underside of the tubes 12 is about 3½". The support member 14 may be formed in the configuration shown by press-bending a flat strip of steel or by feeding an elongated strip of sheet steel between forming rollers to fold the sides 16 and 17 substantially perpendicular to the bight portion 18, and to form the other parts of the support member.

While the flange 19 is shown bent toward the second side 17, it may be bent in the opposite direction. However, bending it in the direction shown allows the weld 34 to be formed at the intersection between the uppermost edge of the wall 16 and the underside of each of the tubes 12 so as to be stronger than if it engaged the thin edge of the flange 19.

The support member 14 is shown supported on rollers of a gravity-flow rack system. Only one such roller 36, which is similar to a roller skate wheel, is shown; other rollers of the track system are directly behind that one. The roller 36 is supported on axle 37 between two U-shaped channel members 38 and 39 that comprise one side of the gravity-flow track system, and a cross member 41 is shown attached to the channel member 38 to extend under the pallet 11 to a similar set of U-shaped channels and rollers that support the other side of the pallet 11. because of the cross member 41 and possibly other immovable objects that could interfere with the pallet 11, the location along the wall 17 at which the shelf 23 is bent outwardly is located such that the roller track contact surface 24 is spaced from the juxtaposed surface of the endmost part of the tubes 12. Typically, the vertical dimension of the portion 28 of the wall 17 is about twice as great as the thickness of the tubes 12, or, in the embodiment shown, about two inches, since the thickness of the tubes 12 is about 1", but it should be understood that such dimensions are only typical and are not to be considered as limiting the invention. The important determining factor is that the support member 14 must be formed in such a way that the roller contact surface 24 can rest on the rollers 36 with the bight portion 18 clearing any obstacles over which it might have to pass, such as the cross member 41. At the same time, the vertical dimension of the first wall 16 must be great enough to permit the tines of the lifting members, whether a fork lift or a hand jack device, to be inserted under the tubes 12 when the pallet 11 is resting on the floor on the bight portion 18.

Figure 3:
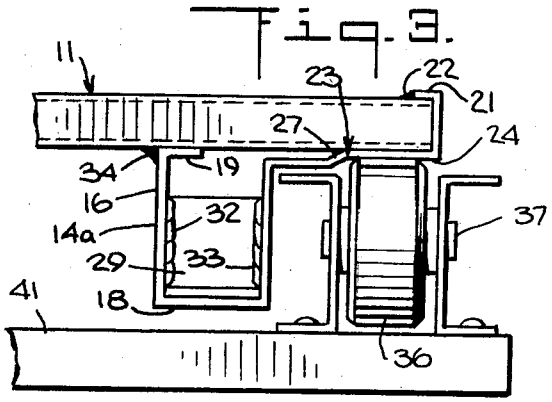
FIG. 3 is an end view corresponding to FIG. 2 but illustrating a different configuration of a roller track member.

If the gravity-flow rack system is arranged so that there are no obstacles like the cross member 41 at the level indicated in FIG. 2, the second side wall **17*a* may be bent at a different location, as shown in FIG. 3. In the embodiment in FIG. 3, the side wall 17***a* is bent at a location such that the shelf 23 is just under the lower surface of the tubes 12, and the upper surface of the roller contact area 24 is directly in contact with the juxtaposed lower surface of the tubes 12. This provides a stronger structure since more of the support member 14 is directly in contact with the tubes 12, which is advantageous, but it requires that there be no interfering structures such as the cross member 41 in FIG. 2. The requirement that the vertical height of the wall 16 be great enough to accomodate the tines of whatever device is likely to be used to lift the pallet still remains true.

The gravity-flow rack system, does not, itself, constitute a part of the invention. However, it is to understood that such gravity-flow systems may be arranged differently than the components for the system shown in FIGS. 2 and 3. For example, it is common for such gravity-flow systems to include pairs of wheels on each axle to increase the supporting area to accomodate heaver loads. Alternatively, it is also well known to stagger the pairs of rollers, so that, although there is only one roller on each axle, successive axles in line one behind the other are so close that alternate rollers have to be offset enough to overlap with each other in a direction perpendicular to the plane of the drawing.

One of the advantages of the present invention is that it is a simple matter to rearrange the bending devices to form the shelf 23 so that the roller contact area 24 is of the proper width to correspond to the roller arrangement of the gravity-feed track system, whether that roller arrangement calls for a single line of rollers, as shown in FIGS. 2 and 3, or multiple rollers. In any case, the web 27 extending longitudinally along the shelf 23 can engage the edge of the rollers 36 to keep the pallet from moving to the right from the position shown in FIGS. 2 and 3, and a corresponding web in the opposite support member 15 (FIG. 1) prevents the pallet 11 from shifting to the left. The web 27 is shown formed at an angle less than 90° , but such a guide member can be formed in other ways, provided only that it affords the necessary guiding function to hold the pallet 11 properly aligned along the gravity flow track system. Since the entire pallet structure is all rigidly assembled together, the guiding function afforded by the web 27 and the corresponding web on the other support member 15 is stable and accurate enough to allow a much larger number of winged pallets according to this invention to be placed on one gravity-flow rack system than the number of composite wood and steel pallets of the type used in the prior art. Furthermore, in spite of the fact that the pallet structure as illustrated in FIGS. 1–3 is extremely strong and rigid and has a life a great deal longer than pallets of the type known heretofore, the pallet 11 can be made so as to be about 45 pounds for a pallet of the same deck area that weighs 75 pounds when constructed compositely of wood and steel in the manner known in the prior art.

While this invention has been described in specific terms, it will be known to those skilled in the art that modifications may be made therein without departing from the true scope of the invention as defined by the following claims.

What is claimed is:

1. A pallet comprising:

a plurality of spaced apart hollow steel tubes comprising first, intermediate, and last tubes substantially parallel to each other and defining a substantially flat deck plane, wherein the length of the tubes define the width of the pallet and the distance between the first and the last of the plurality of tubes define the length of the pallet; and first and second sheet steel support members substantially perpendicular to the tubes, each of said support members comprising a portion of U-shaped cross-section that extends the length of the pallet and that has a bight portion that forms a foot, and first and second sides, the first side being welded to the tubes at a location spaced inwardly from one end region of the respective tubes, the second side having an extended portion bent outwardly, wherein said extended portion comprises first and second horizontal portions vertically offset from each other by an integral web portion spaced horizontally outward from said second side and extending the length of the pallet with said first and second horizontal portions and said web portion all being integrally formed from said extended portion; wherein, said second horizontal portion is outward of said web portion defining a roller contact area, and with the edge of the extended portion of the second side being welded to said one end region of the respective tubes; and wherein, said web portion defines guide member means spaced horizontally outward from said second side by said first horizontal portion and positioned inward from said second horizontal portion defining said roller contact area, whereby the pallet will accurately follow a rail system comprising a plurality of aligned rollers.

2. The pallet according to claim 1 in which the tubes are hollow and rectangular in cross section and have a width approximately twice as great as the thickness thereof and are spaced laterally from each other by a distance at least substantially as great as said width.

3. The pallet according to claim 1 in which the first and second sheet steel support members are substantially mirror images of each other.

4. The pallet according to claim 1 in which the first side of each of the sheet steel support members is bent substantially perpendicularly to form a flange that is held against the underside of the tubes at the location spaced inwardly from one end region of the respective tubes.

5. The pallet according to claim 4 in which the flange is bent outwardly toward the second side of that support member and the weld between the first side and each of the respective tubes comprises a fillet at the intersection of the respective tubes and the surface of the first side opposite the direction in which the flange is bent.

6. The pallet according to claim 4 in which the second side comprises an upwardly bent portion outboard of the roller contact area, and an inwardly bent flange at the edge of the upwardly bent portion and overlapping one end of each of the hollow steel tubes.

7. The pallet according to claim 6 comprising a weld joining the edge of the inwardly bent flange and the adjacent portion of each of the hollow steel tubes.

8. The pallet according to claim 6 in which the upwardly bent portion extends up from the outer part of the roller contact area by a distance greater than the thickness of the tubes, whereby there is a space between the part of the second side comprising the roller contact area and the juxtaposed surfaces of the tubes.

9. The pallet according to claim 6 in which the part of the second side that comprises the roller contact area is substantially in contact with the juxtaposed surface of the tubes.

10. The pallet according to claim 1 comprising a sheet metal bridging member extending across the U-shaped cross section of each of the support members adjacent the bight portion thereof and welded to the first and second sides thereof.

11. The pallet according to claim 10 in which the bridging member is between the first and second sides.

12. The pallet according to claim 11 in which each of the bridging members comprises a short piece of steel tubular material having a channel therethrough similar in cross section to the hollow steel tubes, the channel extending in a direction perpendicular to the longitudinal direction of the respective roller tracks.

* * * * *